United States Patent [19]

Knapp et al.

[11] Patent Number: 4,521,064

[45] Date of Patent: Jun. 4, 1985

[54] ELECTRICAL CONNECTOR HAVING A MOISTURE SEAL

[75] Inventors: Anthony W. Knapp, Laurens; Dee A. Werth, Bainbridge, both of N.Y.

[73] Assignee: Allied Corporation, Morristown, N.J.

[21] Appl. No.: 493,497

[22] Filed: May 11, 1983

[51] Int. Cl.[3] ..... H01R 13/62

[52] U.S. Cl. ..... 339/45 M; 339/94 M

[58] Field of Search ..... 339/94, 60, 45; 384/279, 293, 381, 382; 308/DIG. 5

[56] References Cited

U.S. PATENT DOCUMENTS

| | | | |
|---|---|---|---|
| 3,336,569 | 8/1957 | Nava | 339/94 M |
| 2,752,211 | 6/1956 | Haller | 384/293 |
| 3,091,750 | 5/1963 | Long et al. | 339/94 M |
| 3,458,850 | 7/1969 | Calisher | 339/94 M |
| 3,509,515 | 4/1970 | Acord | 339/45 |
| 3,659,250 | 4/1972 | Horton | 339/94 R |
| 4,279,458 | 7/1981 | Knapp | 339/45 |
| 4,291,927 | 9/1981 | Persson | 384/293 |

*Primary Examiner*—Gil Weidenfeld
*Assistant Examiner*—David L. Pirlot

[57] ABSTRACT

A flat, annular-shaped, seal member (50) comprised of a closed-cell elastomeric foam material is bonded to a radial collar (46) of a tubular adapter (43) mounted to an end portion (24) of a plug shell (20) carrying a slidable sleeve (40) and fixed retainer housing (34) coaxially therearound, an annular air space (S) between end portion (24) and sleeve (40) being sealed against the entry of moisture by a forward face of the seal member (50) and an outer annular margin (D) of the seal member (50) being deformably compressed, respectively, against the retainer housing (34) and the interior wall (41) of sleeve (40).

10 Claims, 3 Drawing Figures

ELECTRICAL CONNECTOR HAVING A MOISTURE SEAL

This invention relates to an electrical connector having a moisture seal.

A "Releasing Electrical Connector" shown in U.S. Pat. No. 4,279,458 issuing July 21, 1981 to Knapp comprises mateable plug and receptacle connectors and means for threadably coupling the connectors together, the specification and drawings of which are specifically incorporated herein by reference. Briefly, the coupling means comprises a segmented forward and rearward housings circumposed around the plug connector, a lanyard operated sleeve circumposed around the housings and several coil springs for biasing the operating sleeve forwardly. In operation, an external "releasing" force on the lanyard causes the operating sleeve to be drawn axially rearward relative to the plug connector and away from the receptacle connector, the springs to be compressed in the rearward housing segments and the forward housing segments to "blossom" radially outward whereupon the assembly is released. While suitable for most uses, the connector must operate in environments where moisture, cold temperatures and ice has a tendency to form.

A current test required by a United States Military specification (viz. MIL-C-38999H) imposes a requirement that this connector operate when immersed in water and then exposed to a temperature of −55° C. Should moisture be received in cavities retaining the springs, a solid column of ice could form around the spring coils and resist rearward compression of the springs. The ice column, being relatively incompressible, could adversely affect the releasing operation by increasing the external force needed on the lanyard to simultaneously crush the frozen ice and compress the springs and, in the worst case, cause the lanyard to break without achieving desired plug and receptacle connector release.

Potting boots are known for their utility in providing strain relief and moisture control. However, although self-contained, the boot is comprised of a solid elastomer and the region around a connection once "potted" is not releasable.

U.S. Pat. No. 3,509,515 issuing Apr. 28, 1972 to Acord for an "Electrical Connector" moisture sealed an air annulus between a pair of slidable sleeves by providing a tightly dimensioned undercut on one sleeve and mounting an O-ring in the undercut of a size sufficient to extend therefrom and contact the inner wall of the other sleeve. While possibly suitable for the connector shown, such an undercut is expensive to manufacture. An O-ring is expensive and typically is comprised of a tough non-porous elastic material having durometer 50 or greater. The ability of such an O-ring to fit tightly into the undercut and provide sustained moisture sealing protection during operation is questionable first because the O-ring must be expanded radially outward about the sleeve before it is snapped into the undercut (which could increase the ring inner diameter) and second because the O-ring could roll or curl during relative sliding contact (which could cause loss of elasticity). During uncoupling rotation of the operating sleeve, the O-ring could increase in diameter and/or bind up to produce erratic torques. MIL-C-38999H requires that a moisture seal produce no erratic torque.

Accordingly, this invention provides a moisture sealed arrangement for an electrical connector assembly which remedies the above defects by preventing moisture from entering and/or freezing in an otherwise exposed portion surrounding sliding sleeves of a releasing electrical connector. The electrical connector includes plug and receptacle connectors and a coupling arrangement carried on the plug for connecting to the receptacle, the coupling arrangement including a spring retainer housing, an operating sleeve having its interior wall circumposed around the housing and a spring (or springs) received in the housing for biasing the sleeve forwardly.

The moisture seal is characterized by a tubular adaptor including a collar extending radially outward therearound and an annular-shaped, surface-contact type seal member bonded to the collar. The tubular adapter is mounted to the plug connector and the collar has its outer periphery spaced from the interior wall of the operating sleeve to define an annular air space therebetween. The seal member has a forward face axially compressed against the spring retainer housing and its outer circumference compressed in a snug fit against and around the interior wall of the operating sleeve. In its undeformed state the seal member is defined by a diameter slightly greater than a diameter defining the interior wall, the seal member thereby having an annular margin extending radially outward from the outer periphery of the collar which is compressibly deformed, the compressed annular margin being adapted to wipe against the interior wall during rotational and longitudinal movement of the operating sleeve during release and in a manner so as to not impede movement during normal coupling and/or uncoupling operations.

Advantages of the moisture seal is provision of a low cost seal, ability to allow for loose manufacturing tolerances, high wearability, positive sealing and elimination of adverse frictional forces on the seal resulting from operation on and by the connector.

One way of carrying out the invention as described below with reference to the drawings which illustrate one specific embodiment of this invention, in which.

Figure 1:
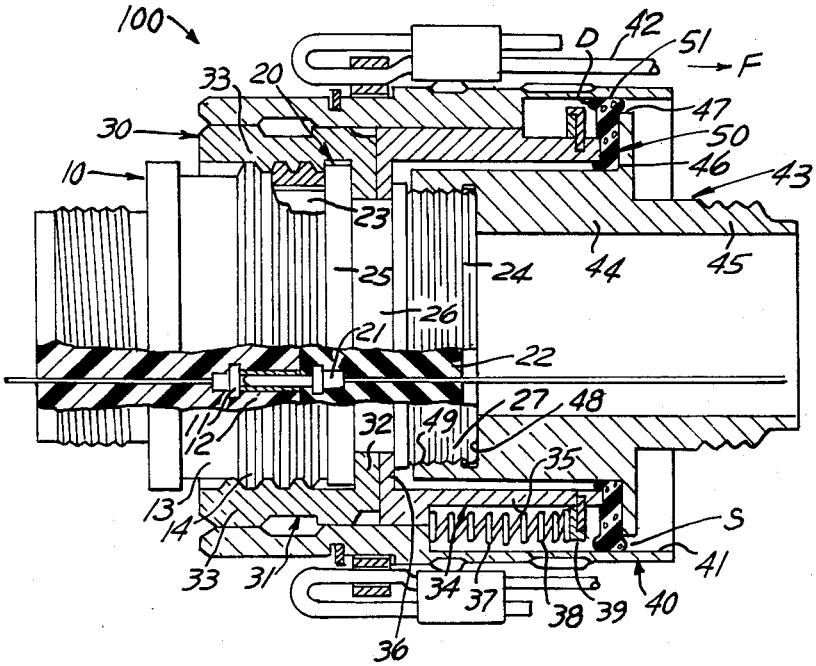
FIG. 1 shows, in partial longitudinal section, a releasing electrical connector having a moisture seal according to the present invention.

Referring now to the drawings, FIG. 1 shows a releasing electrical connector assembly 100 including a first connector member 10 (i.e., a receptacle shell) having a socket-type electrical contact mounted within a dielectric insert 12, a second connector member 20 (i.e., a plug shell) having a pin-type electrical contact 21 mounted in a dielectric insert 22 and a coupling arrangement 30 mounted to plug shell 20 for releasably coupling to receptacle shell 10 whereby the respective pin and socket-type contacts 11, 21 are mated. Of course, the pin and/or socket-type contacts could be other than shown.

Receptacle connector 10 includes a generally cylindrical forward portion 13 having its outer periphery thereof provided with external thread 14. Plug connector 20 includes a generally cylindrical forward and rearward end portion 23, 24, an annular flange 25 disposed medially of its end portions and an annular groove 26 circumjacent the annular flange, the forward end portion 23 thereof being sized to telescope within forward end portion 13 of receptacle connector 10.

The coupling arrangement 30 for releasable coupling the plug and receptacle connector members 10, 20 is shown and described in the aforementioned U.S. Pat. No. 4,279,458 and, briefly, comprises: several arcuate segments 31 and a pair of spring retainer housings 34 arranged annularly with each segment 31 having a radial flange 32 seated within annular groove 26 and a forward end 33 circumposed about forward end portion 23 of plug shell 20 and each retainer housing 34 having a rearward end portion 35 circumposed about rearward end portion 24 of plug shell 20 and a radial flange 36 seated within annular groove 26 rearwardly of the arcuate segments, each retainer housing having a plurality of cavities 37 extending longitudinally; a helical spring 38 disposed in each cavity 37; a retainer ring 39 mounted to the retainer housings; and an operating sleeve 40 having its interior wall 41 circumposed around the above assembly, each helical spring 38 having its forward end abutting a shoulder of operating sleeve 40 and its rearward end abutting retaining ring 39 to normally bias operating sleeve 40 forwardly. A lanyard 42 is mounted to operating sleeve 40 such that an external force applied directly thereto causes operating sleeve 40 to move rearward and arcuate segments 31 to be cammed radially outward (i.e., "blossom") from engagement with external thread 14 formed on receptacle shell 10, this radial "blossoming" of the arcuate segments allowing the plug connector to release from the receptacle connector.

Preferably and in accord with this invention, rearward end portion 24 of plug shell 20 is provided with external thread 27; a tubular adapter 43 is threadably connected to rearward end portion 24 of plug shell 20 and a seal member 50 is disposed on tubular adaptor 43 for sealing the spring cavities 37 against water penetration and ice formation.

Adapter 43 is generally cylindrical in shape and includes forward and rearward end sections 44, 45, a radial collar 46 disposed medially of the end sections, a forward face 48 abutting the end face of plug shell and thread 49 for engaging plug shell 20, the radial collar extending outwardly from the adapter and having a circumferential face 47 disposed in close proximity to interior wall 41 of operating sleeve 40 to define an annular air space designated by "S" therearound.

Seal member 50 is generally planar, annular shaped and molded into one piece from a resilient acelluar silicone-type foam material. The seal member includes an inner operating of a size adapted to snugly-fit about forward end section 44 of adapter 43 and an outer circumferential face 51 of a diameter greater than that of either circumferential face 47 or of interior wall 41 to define a compressible annular margin adapted to be deformably compressed against interior wall 41 of operating sleeve 40.

Figure 2:
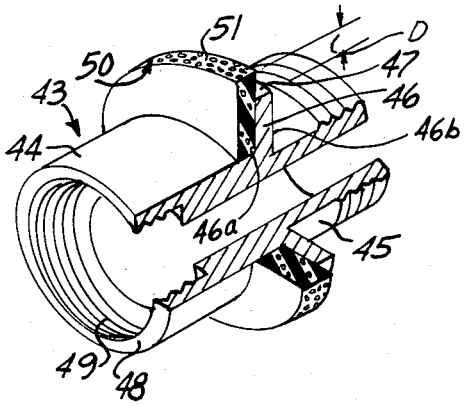
FIG. 2 shows partially in section an adapter having a moisture seal disposed thereon.

FIG. 2 shows radial collar 46 having forward and rearward faces 46*a*, 46*b* and outer circumferential face 47 and seal member 50 bonded to forward face 46*a* of radial collar 46, seal member 50 being in its undeformed state and having outer circumferential face 51 thereof extending radially outward from the collar by an amount shown by "D" to define the compressible annular margin therearound.

Figure 3:
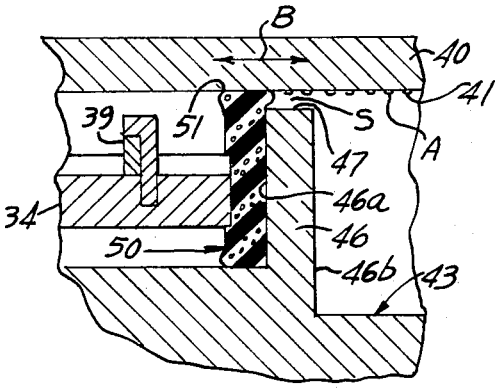
FIG. 3 shows an enlarged view in section of the moisture sealed electrical connector.

FIG. 3 is an enlarged view of seal member 50 and tubular adapter 43 with seal member 50 having its annular margin defined by outward annular extension "D" deformably compressed against interior wall 41 of operating sleeve 40 and its forward face deformably compressed by the end portion of the spring retainer housings 34 such that water entry, such as shown by droplets "A" is resisted upon axial movement of operating sleeve 40 and shown by the arrow "B". Interior wall 41 would not affect the compressed portion of seal 50 upon rotation of operating sleeve 40 (into plane or out from plane of paper) during manual coupling and/or uncoupling rotation.

A ratio of undeformed annular extension "D" to annular air space "S" (i.e. the amount of seal compressed) in the range of 13 to 28 would be sufficient to provide adequate compressibility without introducing adverse rotational/sliding friction with 21.0 providing a good balance. In one particular use, annular air space "S" (i.e. the amount of seal compressed) and extension "D" (i.e. the undeformed seal) were in the range, respectively, of 0.005 in. to 0.013 in. (0.012 cm. to 0.033 cm.) and 0.036 in. to 0.046 in. (0.091 cm. to 0.016 cm.). Preferably the D/S ratio of about 21.0 would be used.

Although many materials could be used, this invention contemplates that seal member 50 be comprised of a closed-cell, spongy, elastic foam material such as silicone rubber. One preferred silicone rubber (polymethyl silane) used has a non-foam (i.e. solid) density of approximately 1.12 grams per cubic centimeters and the preferred foam density being approximately 45% the density of the material when solid, with a preferred range of the material density when foam being 35%–55% of the solid weight. If the foam is chosen of a lesser density, the material has too much of a sponge nature, such that the moisture-proof qualities are reduced or eliminated. If the foam is chosen of a density greater than or approximately 55%, the compressibility of the material is reduced, such that relatively large and undesired frictional forces act between contacted surfaces. The material would preferably have a durometer between 10 and 25 and preferably of 20 or less.

When the seal member is cut into its desired annular shape, the closed-cell, foam exposes many air pockets about its outer circumferential face 51. To enhance resistance to moisture entry, silicone lubricant is applied around circumferential face 51 such that these air pockets trap the lubrication and maintain the desired lubricated condition as well as increase the effectiveness of sealing against moisture entry in the connector releasing mode. One advantage of seal 50 being formed from such a soft silicone material allows for greater seal surface contact without introduction of adverse frictional forces and greater compensation for eccentricity in metal parts which normally exist during manufacturing. During motion of operating sleeve 40, the soft accellular elastomeric material will gently wipe against the moving surface (i.e., interior wall 41) to resist droplets "A" from entering the connector assembly.

We claim:

1. An electrical connector assembly having a moisture seal, the assembly comprising: a pair of mated electrical connector members with one of said connector members including a rearward end portion; and coupling means mounted on one of said connectors for releasably coupling the connector members together, said relesable coupling means including a spring retainer mounted to the one connector, a tubular sleeve having its interior wall circumposed about and mounted for longitudinal movement rearwardly of said spring retainer, and a spring disposed in said retainer for resisting rearward movement of said sleeve, said moisture seal sealing said coupling means against the entry of moisture, said moisture seal being characterized by:

an adaptor mounted to the rearward end portion of said one connector member, said adaptor including a radial collar defining a planar forward face spaced longitudinally rearward from said spring retainer and an outer circumferential face spaced radially inward from the interior wall of said sleeve to define an annular air space (S) therebetween; and a one-piece, substantially flat and annular shaped seal member bonded to the forward face of said collar, said seal member being comprised of a spongy elastic foam and having a forward surface deformably compressed against the spring retainer and its outer periphery deformably compressed against the interior wall of said sleeve.

2. The connector assembly as recited in claim 1 wherein said annular-shaped seal member includes a central opening the inner periphery of which is interference fit around the adaptor.

3. The connector assembly as recited in claim 1 wherein said seal member is comprised of a closed-cell silicone elastomer having a durometer in the range between 10 and 25.

4. The connector assembly as recited in claim 1 wherein said seal member is comprised of a closed-cell silicone elastomer having a durometer of approximately 20.

5. The connector assembly as recited in claim 1 wherein said seal member has an extension (D) in its undeformed state that extends radially outward relative to the circumferential face by an amount greater than the dimension defining said annular air space (S), a ratio of said extension (D) to said annular air space (S) being approximately 21.0.

6. The connector assembly as recited in claim 1 wherein said seal member is comprised of a closed-seal foam elastomeric material such as polymethyl silane.

7. The connector assembly as recited in claim 1 wherein said seal member is cut from a closed-foam material such that air pockets on the outer circumferential face are exposed and provided with a silicone lubricant.

8. The connector assembly as recited in claim 1 wherein the density of the elastomer foam is chosen to be in the range of approximately 35%–55% of the density of a solid piece of the same material.

9. The connector assembly as recited in claim 8 wherein the density of the elastomer foam is approximately 45% of the density of a solid piece of the same material.

10. In a releasing connector for mating to a compatible connector and exposed to unwanted moisture entry, said releasing connector comprising a first shell including a rearward tubular extension having a transverse rear face and a collar extending radially outward therefrom, a tubular sleeve having its inner wall circumposing the outer circumference of said collar and mounted for longitudinal movement relative to said collar, means connected to said first shell for resisting rearward movement of said sleeve, and means for sealing against moisture entry between said collar and said tubular extension, said sealing means characterized by an annular, one-piece, planar seal member comprised of a spongy elastic foam being bonded to said collar so that a portion of a planar forward surface of the annular seal member is deformably compressed against the transverse rear face of said tubular extension and the outer periphery of said seal member is deformably compressed against the inner wall of said tubular sleeve.

* * * * *